US008770908B2

(12) United States Patent
Tan et al.

(10) Patent No.: US 8,770,908 B2
(45) Date of Patent: Jul. 8, 2014

(54) TILT CYLINDER SUPPORT STRUCTURE

(75) Inventors: Xiaoming Tan, Apex, NC (US); Michael Sekulich, Raleigh, NC (US); Allen Boyer, Cary, NC (US); Robert Hunter, Wake Forest, NC (US); Sameer Rishipathak, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 636 days.

(21) Appl. No.: 13/045,193

(22) Filed: Mar. 10, 2011

(65) Prior Publication Data

US 2012/0230804 A1 Sep. 13, 2012

(51) Int. Cl.
*B66C 23/00* (2006.01)

(52) U.S. Cl.
USPC ..... 414/686; 414/685; 414/697; 414/722; 37/443

(58) Field of Classification Search
USPC ..... 414/722, 685, 686, 697; 37/443, 444
See application file for complete search history.

(56) References Cited

U.S. PATENT DOCUMENTS

| | | | | |
|---|---|---|---|---|
| 4,349,307 | A | 9/1982 | Klem | |
| 4,858,345 | A | 8/1989 | Abe et al. | |
| 5,292,079 | A | 3/1994 | Zakohji | |
| 5,988,309 | A | 11/1999 | Chong et al. | |
| 6,098,870 | A | 8/2000 | Deneve et al. | |
| 6,168,368 | B1 * | 1/2001 | Apgar et al. | 414/686 |
| 2005/0047898 | A1 | 3/2005 | Latham et al. | |
| 2006/0291987 | A1 * | 12/2006 | Osanai et al. | 414/685 |

FOREIGN PATENT DOCUMENTS

| | | |
|---|---|---|
| JP | 11303139 | 11/1999 |
| JP | 2007112264 | 5/2007 |
| JP | 2010196408 | 9/2010 |

* cited by examiner

*Primary Examiner* — Dean Kramer
*Assistant Examiner* — Gabriela Puig
(74) *Attorney, Agent, or Firm* — Miller, Matthias & Hull

(57) ABSTRACT

A support structure for a tilt cylinder of a machine that controls movement of an articulating implement may include a mounting plate, vertical support plates extending outwardly from a top surface of the mounting plate, and a central and side gussets connected to the top surface of the mounting plate and to the outer sides of the vertical support plates. The gussets assist in transitioning lateral or horizontal forces on the vertical support plates to the mounting plate and the end frame of the machine to reduce fatigue cracking at the points of connection of the vertical support plates to the mounting plate. The support structure may further include first and second lower support plates having top edges spaced from each other and connected to the bottom surface of the mounting plate, and bottom edges connected to each other so that the lower support plates and the mounting plate form a triangle in cross-section to further assist in transitioning the forces to the end frame.

20 Claims, 6 Drawing Sheets

TILT CYLINDER SUPPORT STRUCTURE

TECHNICAL FIELD

This disclosure relates generally to machines having articulating ground-engaging implements and, in particular, to support structures for tilt cylinders that control the movement of such articulating implements.

BACKGROUND

Machines, such as wheel loaders, track loaders, backhoe loaders and the like known in the art, are used for moving material from one place to another at a worksite. These machines include a body portion housing the engine and having rear wheels driven by the engine and an elevated operator environment, such as a cab, for the operator. In wheel loader machines, a front non-engine end frame with the front wheels is attached to the body portion by an articulated connection allowing the end frame to pivot from side-to-side to steer the machine. The end frame may further include linkages, such as Z-bar linkages, for manipulating an implement of the machine. A pair of lift arms coupled to the end frame are raised and lowered by corresponding lift cylinders to adjust the elevation of the implement above the ground. Where Z-bar linkages are used, the tilt of the implement (rotation of the implement about a pivot connection at the end of the lift arms) is controlled by a tilt lever and tilt link coupled between the lift arms and the implement, and driven by a tilt cylinder. An example of a wheel loader machine implementing a Z-bar linkage is provided in U.S. Publication No. 2006/0291987, published Dec. 28, 2006. Other types of machines and other types of linkages having tilt cylinders operatively coupled to their implements are also known in the art.

In known machines having tilt cylinders, an end of the tilt cylinder opposite an end connected to the tilt lever is pivotally connected to the frame by a pair of upwardly extending support plates. The support plates are typically welded to a base plate or mounting plate of the frame at their bottom edges. Support plates are generally parallel to each other and to a longitudinal axis extending from the front to the back of the machine. The plates have circular openings there through, with an end of the tilt cylinder being disposed there between. A pivot pin extends through the openings and the end of the tilt cylinder so that the tilt cylinder to rotate about the pivot pin. The other end of the tilt link is coupled to the implement via the tilt link and tilt lever.

As a tilt cylinder operates to articulate the implement, forces in the direction of the longitudinal axis of the tilt cylinder are generated and act on the pivot pin as shear forces perpendicular to the longitudinal axis of the pivot pin. These forces in turn are transmitted to the support plates in the longitudinal direction of the machine. The support plates oriented as described have sufficient surface contact between the support plates and the base plates in the longitudinal direction to transition the longitudinal loads without failure for the duration of the design life of the support plates.

The longitudinal loads constitute the majority of the loads that are borne by the support plates. However, horizontal loads acting in the direction perpendicular to the longitudinal direction of the machine and parallel to the longitudinal axis of the pivot pin are also applied to the support plates. The horizontal loads may be generated when an unbalanced load is applied to the implement, or when other lateral loads are applied to the implement due to engagement with other objects. These loads are the result of the use of the machines in extreme settings. The typical design of the support plates focuses on the longitudinal structure transition between the support plates and the mounting plate. The horizontal loads and structure transition are considered, but the support plates are relatively thin in the horizontal direction in contrast to the longitudinal direction. This design renders the support plates relatively weak in horizontal transition, and can result in cracking of the support plates or the welds attaching the support plates to the mounting plate due to fatigue caused by the repetitive horizontal loading. Therefore, a need exists for an improved tilt cylinder support structure providing increased resistance to horizontal loading, and a corresponding increase in the useful life of the support structure.

SUMMARY OF THE DISCLOSURE

In one aspect of the present disclosure, the invention is directed to a support structure for a tilt cylinder of a machine. The support structure may include a mounting plate having a top surface and an oppositely disposed bottom surface, a first vertical support plate perpendicular to the mounting plate and having a bottom edge connected to the top surface of the mounting plate, and a second vertical support plate perpendicular to the mounting plate, parallel to and spaced from the first vertical support plate, and having a bottom edge connected to the top surface of the mounting plate. The first and second vertical support plates may have circular openings there through proximate top edges of the vertical support plates. The support structure may further include a front central gusset perpendicular to the mounting plate, and perpendicular to and disposed between the first and second vertical support plates. The front central gusset may have a bottom edge connected to the top surface of the mounting plate and oppositely disposed lateral edges each connected to a corresponding one of the first and second vertical support plates. The support structure may also include first and second front side gussets perpendicular to the mounting plate and to the vertical support plates, and having bottom edges connected to the top surface of the mounting plate and lateral edges connected to sides of the corresponding vertical support plates opposite the other of the vertical support plates and the front central gusset, and aligned with the front central gusset.

In another aspect of the present disclosure, the invention is directed to an end frame for a machine having a work material engaging implement, a tilt cylinder and a tilt cylinder support structure. The tilt cylinder may include a first and a second and, with the first and being operatively connected to the implement, and with the tilt cylinder being operable to adjust and orientation of the implement relative to the end frame. The support structure may include a mounting plate having a top surface and an oppositely disposed bottom surface, a first vertical support plate perpendicular to the mounting plate and having a bottom edge connected to the top surface of the mounting plate, and a second vertical support plate perpendicular to the mounting plate, parallel to and spaced from the first vertical support plate, and having a bottom edge connected to the top surface of the mounting plate. The first and second vertical support plates may have circular openings there through proximate top edges of the vertical support plates. The support structure may further include a front central gusset perpendicular to the mounting plate, and perpendicular to and disposed between the first and second vertical support plates. The front central gusset may have a bottom edge connected to the top surface of the mounting plate and oppositely disposed lateral edges each connected to a corresponding one of the first and second vertical support plates. The support structure may also include first and second front side gussets perpendicular to the mounting plate and to the vertical support plates, and having bottom edges connected to the top surface of the mounting plate and lateral edges connected to sides of the corresponding vertical support plates opposite the other of the vertical support plates and the front central gusset, and aligned with the front central gusset. The second end of the tilt cylinder may be pivotally connected to the tilt cylinder support structure at the circular openings of the vertical support plates.

In a further aspect of the present disclosure, the invention is directed to a support structure for a tilt cylinder of a machine. The support structure may include a mounting plate having a top surface and an oppositely disposed bottom surface, a first vertical support plate having a bottom edge connected to the top surface of the mounting plate, and a second vertical support plate spaced from the first vertical support plate, and having a bottom edge connected to the top surface of the mounting plate. The first and second vertical support plates may have circular openings there through proximate top edges of the vertical support plates. The support structure may further include a front central gusset disposed between the first and second vertical support plates and having a bottom edge connected to the top surface of the mounting plate and oppositely disposed lateral edges each connected to a corresponding one of the first and second vertical support plates. The support structure may also include first and second front side gussets having bottom edges connected to the top surface of the mounting plate and lateral edges connected to sides of the corresponding vertical support plates opposite the other of the vertical support plates and the front central gusset, and aligned with the front central gusset. Still further, the support structure may include a first lower support plate having a bottom edge and a top edge disposed opposite the bottom edge and connected to the bottom surface of the mounting plate, and a second lower support plate having a bottom edge and a top edge disposed opposite the bottom edge and connected to the bottom surface of the mounting plate with the top edge of the first lower support plate being spaced from the top edge of the second lower support plate, and wherein the bottom edge of the first lower support plate is connected to the bottom edge of the second lower support plate so that the first and second lower support plates and a portion of the mounting plate disposed between the top edges of the first and second lower support plates form a triangle in cross-section.

Additional aspects of the invention are defined by the claims of this patent.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
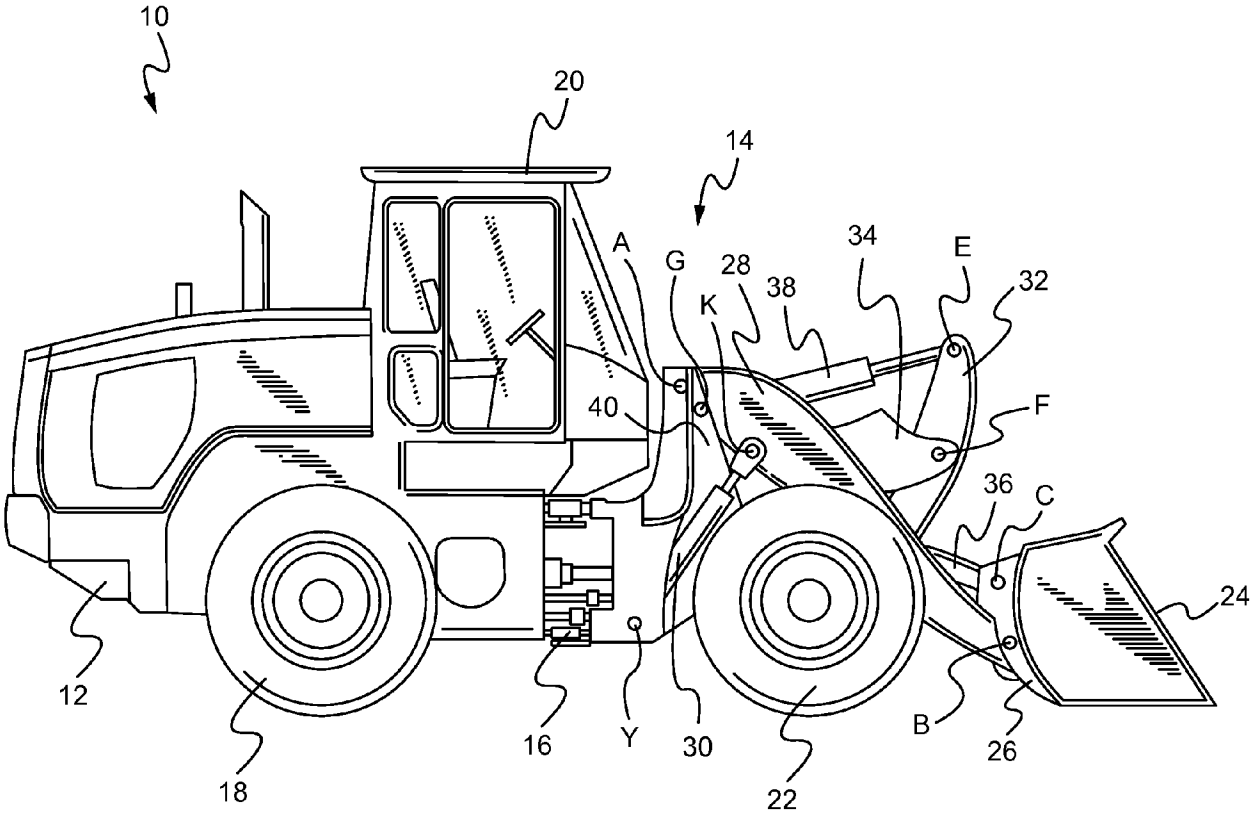
FIG. 1 is a side elevation view of a machine having an articulating ground-engaging implement and a tilt cylinder support structure in accordance with the present disclosure.

FIG. 1 illustrates an embodiment of a wheel loader machine 10 that may implement a tilt cylinder support structure in accordance with the present disclosure. Use of the wheel loader machine 10 as exemplary, and those skilled in the art will understand that the tilt cylinder support structure discussed herein may be implemented in other types of machines having tilt cylinders for articulation of a ground engaging implement. The wheel loader machine 10 includes a body portion 12 and a non-engine end frame 14 connected by an articulating joint 16. The body portion 12 houses an engine that drives rear wheels 18, and includes an elevated operator environment 20, such as a cab, for the operator. The end frame 14 has front wheels 22 that are mounted to a front axle, with the articulating joint 16 allowing the end frame 14 to move from side-to-side to steer the wheel loader machine 10. In the illustrated embodiment, an implement in the form of a bucket 24 is mounted at the front of the end frame 14 on a coupler 26. The bucket 24 and coupler 26 may be configured for secure attachment of the bucket 24 during use of the wheel loader machine 10, and for release of the bucket 24 and substitution of another implement. Although the coupler 26 and bucket 24 are illustrated and described as being separate connectable components, those skilled in the art will understand that each implement, including buckets, may be configured as a unitary component having a material engaging portion, such as the bucket or forks, and a coupling portion having the points of attachment for connecting the implement to the machine 10.

The coupler 26 is connected to the end frame 14 by a pair of lift arms 28. One end of each lift arm 28 is pivotally connected to the end frame 14 and the other end is pivotally connected to the coupler 26 proximate the bottom. The lift arms 28 rotate about the point of connection to the end frame 14, with the rotation of the lift arms 28 being controlled by corresponding lift cylinders 30 pivotally coupled to the end frame 14 and the lift arms 28. The lift cylinders 30 may be extended to raise the lift arms 28 and retracted to lower the lift arms 28. In typical implementations, two lift arms 28 are provided, with each having a corresponding lift cylinder 30.

However, a single lift arm 28 and lift cylinder 30, two lift arms 28 driven by a single lift cylinder 30, or other arrangements of lift arms 28 and lift cylinders 30 providing similar functionality as kinematic elements may be implemented, and are contemplated by the inventors as having use in wheel loader machines in accordance with the present disclosure.

The rotation of the coupler 26 and attached implement 24 may be controlled by a Z-bar linkage of the end frame 14. The Z-bar linkage may include a tilt lever 32 pivotally connected to a tilt lever support 34 mounted on the lift arms 28 such that the tilt lever support 34 moves with the lift arms 28. At one end of the tilt lever 32, a tilt link 36 has one end pivotally connected to the end of the tilt lever 32, and the opposite end pivotally connected to the coupler 26 proximate the top. A tilt cylinder 38 couples the opposite end of the tilt lever 32 to the end frame 14 with pivotal connections at either end. For a given position of the lift arms 28, the coupler 26 and implement are rotated toward the racked position by extending the tilt cylinder 38, and rotated in the opposite direction toward the dump position by retracting the tilt cylinder 38.

Each of the connections between the elements that move with respect to one another is made by a pivot pin about which the elements rotate. Consequently, the lift arms 28 may be connected to the end frame 14 by pivot pins A and to the coupler 26 by pivot pins B. The tilt link 36 may be connected to the coupler 26 by a pivot pin C and to the tilt lever 32 by a pivot pin D. The tilt lever 32 may be connected to the tilt cylinder 38 by a pivot pin E and to the tilt lever support 34 by a pivot pin F. The opposite end of the tilt cylinder 38 may be connected to the support structure of the end frame 14 by a pivot pin G, the position of which is indicated in FIG. 1 though the pivot pin G and support structure are hidden by one of the lift arms 28 and a tower plate 40. Finally, the lift cylinders 30 may be connected to the lift arms 28 by pivot pins K and to the end frame 14 by pivot pins Y. Because the pivot pins A, G, Y are attached to the end frame 14, the distance between the pivot pins A, G, Y if fixed.

Figure 2:
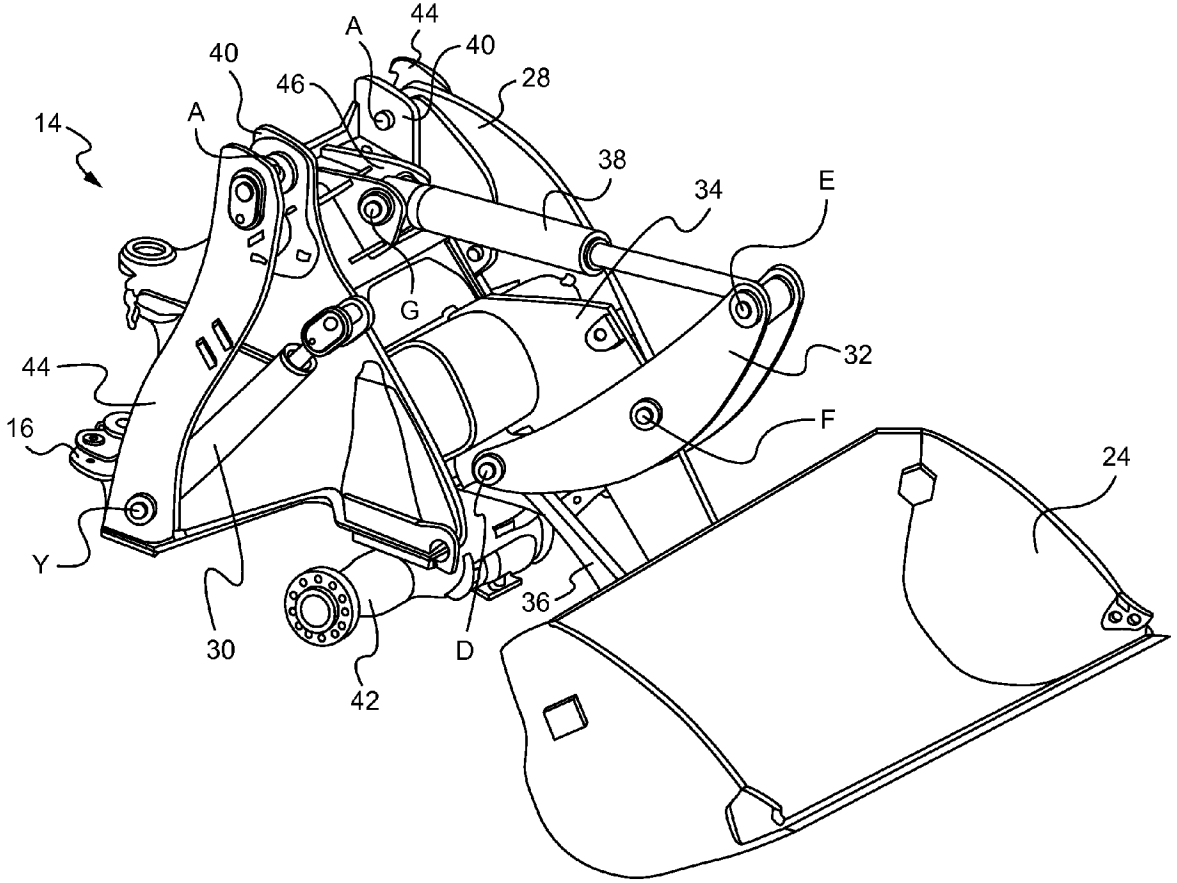
FIG. 2 is a perspective view of the front end frame of the machine of FIG. 1 with the front wheels and one of the lift arms removed for clarity.

The end frame 14 is shown in greater detail in the FIG. 2 with the lift arm 28 from the foreground removed, as well as the front wheels 22 being removed from the front axle 42 for clarity. The lift arms 28 may be connected to the end frame 14 via the pivot pins A between the tower plates 40 and outboard supports 44. The tilt lever support 34 may be connected between the lift arms 28 so that the tilt lever 32 is raised and lowered along with the lift arms 28 when the lift cylinders 30 are extended and retracted, respectively. In this view, the end of the tilt cylinder 38 opposite the tilt lever 32 can be seen, with the pivot pin G connecting the end of the tilt cylinder 38 to a tilt cylinder support structure 46 in accordance with the present disclosure. As the lift arms 28 are raised and lowered, the tilt cylinder 38 pivots about the pivot pin G.

The weight of the implement 24 and a load disposed therein tend to rotate the implement 24 in a clockwise direction about the pivot pin B as shown in FIG. 1. The load creates a tensile force on the tilt link 36 rotating the tilt lever 32 in a counterclockwise direction, and generating a corresponding compression load on the tilt cylinder 38. This longitudinal load is transitioned to the end frame 14 by the pivot pin G and the support structure 46. Due to the play within the joints and the general usage of the machine 10 in extreme environments, lateral or horizontal loads on the implement 24 are transmitted through the kinematic elements of the end frame 14 to the support structure 46. The support structure 46 in accordance with the present disclosure may be configured to transition these loads to the end frame 14 as well without failure of the support structure 46 due to fatigue over an extended period of time.

Figure 3:
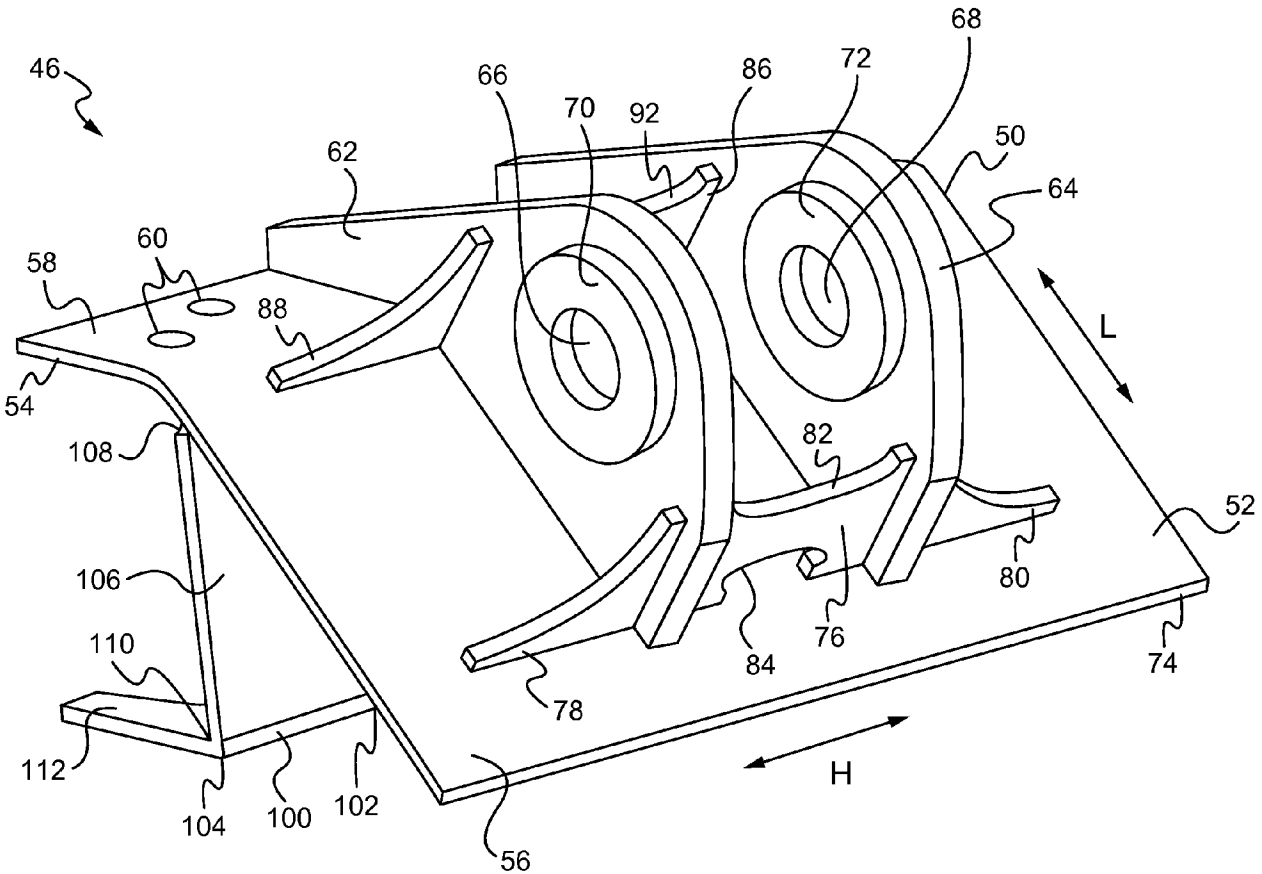
FIG. 3 is a perspective view of the tilt cylinder support structure of the machine of FIG. 1.

FIG. 3 illustrates an embodiment of the tilt cylinder support structure 46 that may be implemented in the end frame 14. The illustration includes a first arrow L generally indicating the longitudinal direction extending from the front to the rear of the machine 10. A second arrow H indicates a generally horizontal direction perpendicular to the longitudinal direction of the machine 10. The support structure 46 includes a mounting plate 50 having a top surface 52 and an oppositely disposed bottom surface 54. The mounting plate 50 may be divided into a first planar portion 56 and a second planar portion 58 oriented at an angle with respect to each other. When connected to the end frame 14, the second planar portion 58 may have a generally horizontal orientation. The second planar portion 58 may include one or more hydraulic tube openings 60 through which hydraulic supply lines may pass for connection to the tilt cylinder 38.

The support structure 46 may further include first and second vertical support plates 62, 64 extending outwardly from the top surface 52 of the mounting plate 50. Bottom edges of the vertical support plates 62, 64 may be welded or otherwise secured to the top surface 52 of the mounting plate 50 with their long dimensions aligned in the longitudinal direction of the machine 10. The bottom edges of the vertical support plates 62, 64 may be contoured to conform to the shape of the top surface 52 defined by the planar portions 56, 58 of the mounting plate 50. The vertical support plates 62, 64 may be spaced apart a sufficient distance for insertion of the end of the tilt cylinder 38 there between. The vertical support plates 62, 64 may include circular openings 66, 68, respectively, there through proximate top edges of the vertical support plates 62, 64 for insertion of the pivot pin G to hold the end of the tilt cylinder 38 in place on the support structure 46. Cylindrical pivot reinforcements 70, 72 may surround the corresponding circular openings 66, 68 to provide additional structural support for the vertical support plates 62, 64 to withstand the forces transmitted by the pivot pin G.

Figure 5:
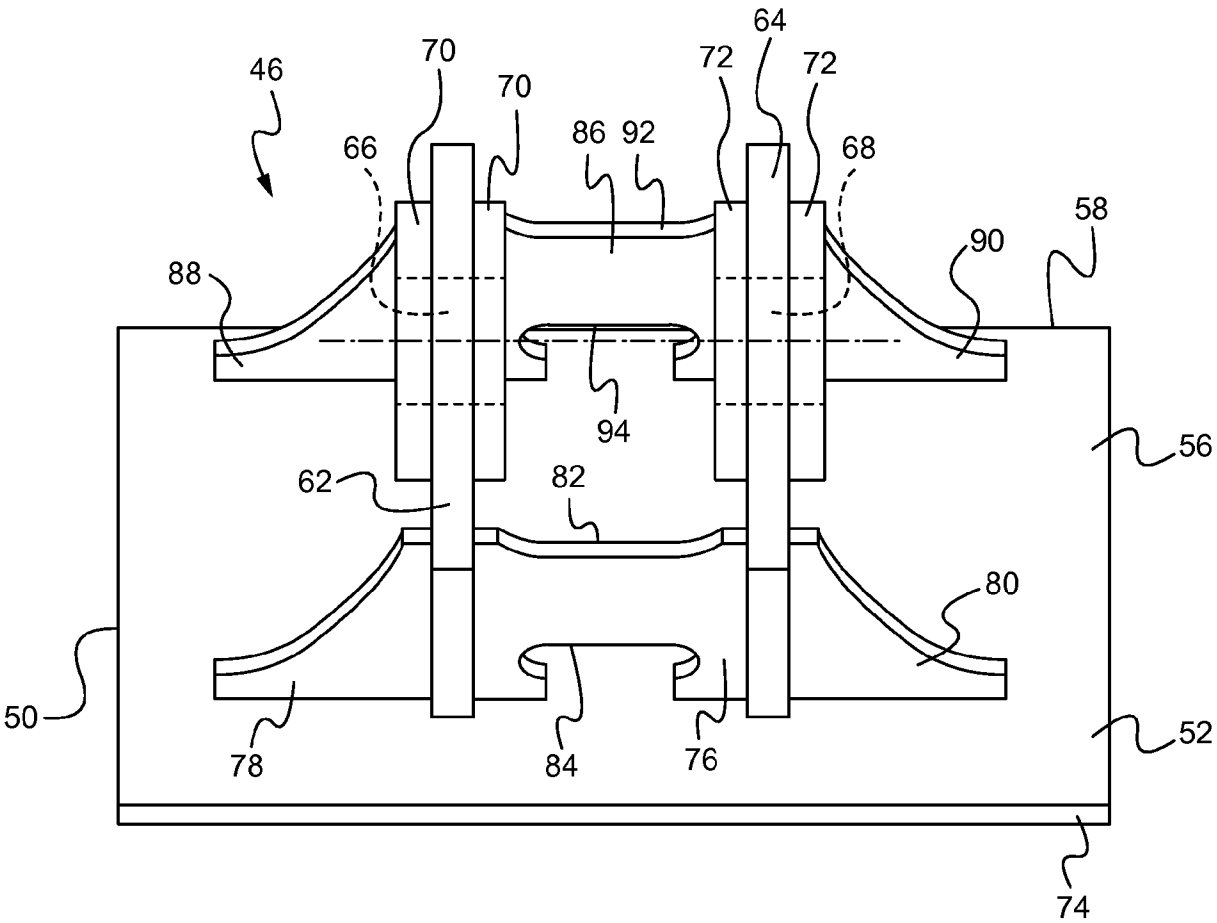
FIG. 5 is a front view of the tilt cylinder support structure of FIG. 3.

Lateral support for the vertical support plates 62, 64 may be provided by a system of gussets reinforcing the vertical support plates 62, 64 against each other and to the top surface 52 of the mounting plate 50. Proximate a front edge 74 of the mounting plate 50, a front central gusset 76 may be disposed between the vertical support plates 62, 64, and front side gussets 78, 80 may be disposed on the outward sides of the corresponding one of the vertical support plates 62, 64. The front central gusset 76 may have a bottom edge welded or otherwise connected to the top surface 52 of the mounting plate 50, and oppositely disposed lateral edges each welded or otherwise connected to an inner surface of a corresponding one of the vertical support plates 62, 64. The first front side gusset 78 may have a bottom edge welded or otherwise connected to the top surface 52 of the mounting plate 50, and a lateral edge connected to the outward side of the vertical support plate 62. Similarly, the second front side gusset 80 may have a bottom edge welded or otherwise connected to the top surface 52 of the mounting plate 50, and a lateral edge connected to the outward side of the vertical support plates 64. The front side gussets 78, 80 may be aligned with the front central gusset 76 in the horizontal direction to further assist in transitioning the horizontal loads from the vertical support plates 62, 64 to the mounting plate 50. The gussets a 76-80 may also be shaped to reduce or eliminate high stress concentrations and to minimize their weight and material. Consequently, for example, the front central gusset 76 may include an upper cut out portion 82 and lower cut out portion 84 where material is removed without compromising the structural integrity of the front central gusset 76. The upper cut out portion 82 may also provide clearance for and received the tilt cylinder 38 therein as the tilt cylinder 38 pivots about the pivot pin G during use of the machine 10. The rearward portions of the vertical support plates 62, 64 may similarly be supported latterly by a rear central gusset 86 and rear side gussets 88, 90 (FIG. 5). The rear central gusset 86 may have a similar configuration as the front central gusset 76, including upper cut out portion 92 and lower cut out portion 94, and may be horizontally aligned with the rear side gussets 88, 90.

The components extending outwardly from the top surface 52 of the mounting plate 50 have been generally described as being welded to the top surface 52 at their lower edges. However, those skilled in the art will understand that the vertical support plates 62, 64 and the gussets 76-80, 86-90 may be connected to the top surface 52 by any appropriate mechanical connection mechanism or combination of mechanical connection mechanisms. Moreover, the mounting plate 50, the vertical support plates 62, 64 and the gussets 76-80, 86-90 may be integrally formed as a single unitary component by die casting, forging or any other appropriate method of fabrication.

Figure 4:
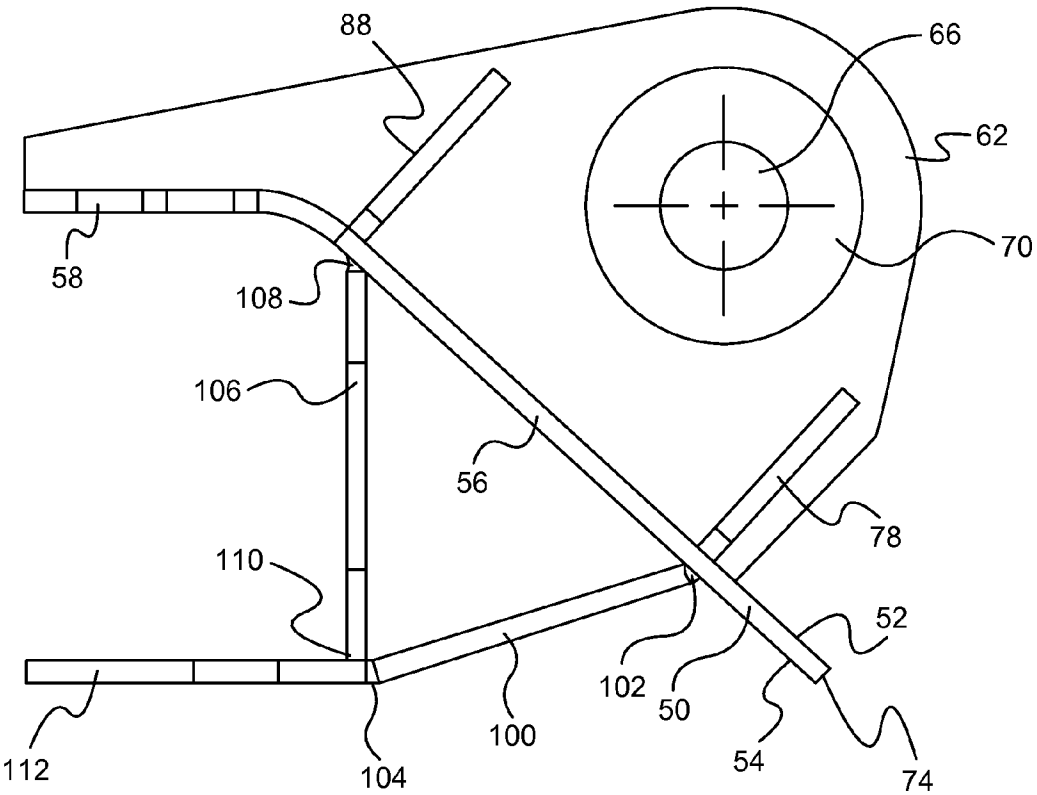
FIG. 4 is a side view of the tilt cylinder support structure of FIG. 3.

In the embodiment of the tilt cylinder support structure 46 shown in FIGS. 3-5, the vertical support plates 62, 64 and the gussets 76-80, 86-90 are illustrated as being oriented perpendicular to the top surface 52 of the mounting plate 50. The vertical support plates 62, 64 are parallel to each other, and the front gussets 76-80 are parallel to the rear gussets 86-90, and perpendicular to the vertical support plates 62, 64. Of course, depending on the implementation and the lines of action of the forces acting on the support structure 46, the components of the support structure 46 may be oriented at different angles with respect to each other, and may have shapes other than the generally planar shapes illustrated herein. For example, the vertical support plates 62, 64 may be spaced with more distance between each other at the point of connection to the top surface 52 of the mounting plate 50 and angle inwardly towards each other before terminating in upper generally vertical portions in which the circular openings 66, 68 are located. The gussets 76-80, 86-90 may be shaped accordingly to correspond to the orientations of the vertical support plates 62, 64. Other appropriate orientations and shapes may be apparent to those skilled in the art, and are contemplated by the inventors as having use in tilt cylinder support structures 46 in accordance with the present disclosure.

Transitioning of the lateral or horizontal forces from the support structure 46 to the end frame 14 is further facilitated by providing additional support at the bottom surface 54 of the mounting plate 50. The support structure 46 may further include a first or front lower support plate 100 having a top edge 102 welded or otherwise connected to the bottom surface 54 of the mounting plate 50, and an oppositely disposed bottom edge 104. A second or rear lower support plate 106 may have a top edge 108 that is spaced from the top edge 102 of the front lower support plate 100, and welded or otherwise connected to the bottom surface 54. An oppositely disposed bottom edge 110 of the rear lower support plate 106 may be welded or otherwise connected to the bottom edge 104 of the front lower support plate 100 so that the front and rear lower support plates 100, 106 and a portion of the mounting plate 50 disposed between the top edges 102, 108 of the front and rear lower support plates 100, 106 form a triangle in cross-section as is most clearly shown in the side view of FIG. 4. An additional support plate 112, which may be a separate component or a portion of one of the lower support plates 100, 106, may be added to provide additional horizontal load-bearing support for the support structure 46.

Though not required, the lower support plates 100, 106 may be positioned to cooperate with the front gussets 76-80 and the rear gussets 86-90 in transitioning the loads to the end frame 14. Again referring to FIG. 4, the structure formed by the lower support plates 100, 106 may be aligned with the structures attached to the top surface 52 of the mounting plate 50. In this embodiment, the top edge 102 of the front lower support plate 100 may be attached to the bottom surface 54 of the mounting plate 50 at a position opposite the point of attachment of the front gussets 76-80. Similarly, the top edge 108 of the rear lower support plate 106 may be attached to the bottom surface 54 at the position opposite the point of attachment of the rear gussets 86-90. When the lateral loads are applied to the vertical support plates 62, 64 by the tilt cylinder 38, the forces are transitioned through the gussets 76-80, 86-90 to the corresponding lower support plates 100, 106 and to the end frame 14. The lower support plates 100, 106 may prevent bending or buckling of the mounting plate 50 that may be caused by the torsional loading resulting from the application of the lateral forces at a distance from the mounting plate 50 approximately equal to the distance from the top surface 52 the mounting plate 50 to the center of the circular openings 66, 68. The triangular structure of the lower support plates 100, 106 and mounting plate 50 may also provide additional reinforcement for the transitioning of the longitudinal loads applied by the tilt cylinder 38 to the structure of the end frame 14.

As discussed above, the lower support plates 100, 106, 112 may be separate components welded or otherwise connected to each other and to the bottom surface 54 of the mounting plate 50. The lower support plate 112 may be an individual component, or may be a separate portion of one of the lower support plates 100, 106. Alternatively, the lower support plates 100, 106, 112 may be fabricated as a single unitary component, with the top edges 102, 108 of the lower support plates 100, 106 being welded to the bottom surface 54 of the mounting plate 50. As a further alternative, lower support plates 100, 106, 112 may be fabricated as a single unitary component along with the mounting plate 50, or the lower support plates 100, 106, 112, mounting plate 50, vertical support plates 62, 64 and gussets 76-80 and 86-90 may be fabricated as a single unitary component, such as by a steel casting process. Additional configuration and attachments of the various components of the tilt cylinder support structure 46 will be apparent to those skilled in the art and are contemplated by the inventors as having use in the support structure 46 in accordance with the present disclosure.

Figure 6:
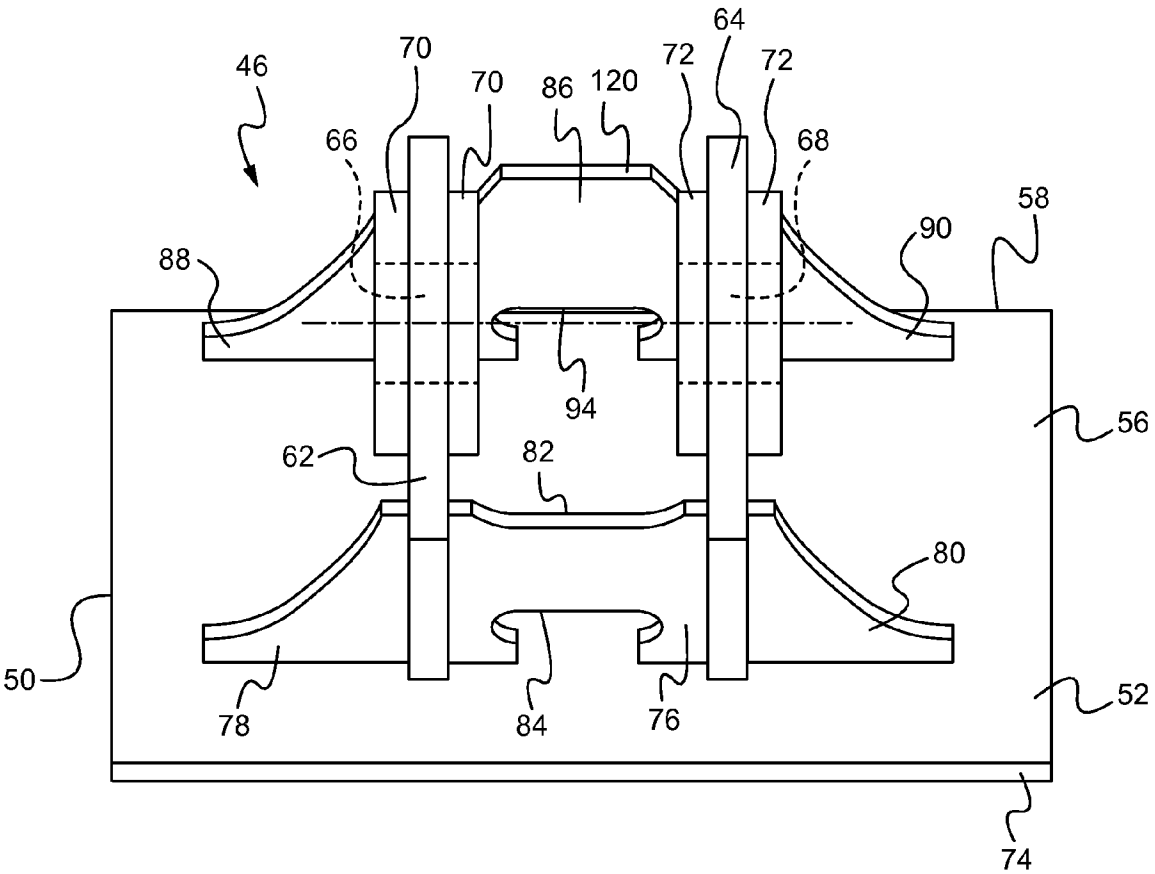
FIG. 6 is a front view of the tilt cylinder support structure of FIG. 3 with an alternative embodiment of the rear central gusset.

When the end frame 14 is fully assembled and with the tilt cylinder 38 connected to the tilt lever 32 at pivot pin E, the motion constraints of the kinematic elements prevents the tilt cylinder 38 from rotating rearwardly about pivot pin G to the point of entering the operator environment 20. However, when the tilt cylinder 38 is detached from the tilt lever 32, the tilt cylinder 38 may be able to enter the operator environment 20. FIG. 6 illustrates an alternate embodiment of the tilt cylinder support structure 46 wherein the rear central gusset 86 is configured to act as a catch plate for the tilt cylinder 38. The rear central gusset 86 may include an upper raised portion 120 that extends a sufficient distance upwardly to engage the tilt cylinder 38 when the end opposite the pivot pin G is freed from the kinematic constraints, but terminate before a point at which the tilt cylinder 38 engages the upper raised portion 120 when motion is constrained by the other kinematic elements of the end frame 14. Of course, depending on the operational requirements, the upper raised portion 120 may be extended to a position at which the tilt cylinder 38 is engaged before rotating to the upper limit of the constrained motion to function as a mechanical stop.

INDUSTRIAL APPLICABILITY

The assembled tilt cylinder support structure 46 may be integrated into the end frame 14 as shown in FIG. 2. The support structure 46 is disposed between the upper ends of the tower plates 40 proximate the connection of the lift arms 28 at pivot pins A. The lateral edges of the mounting plate 50 and lower support plates 100, 106, 112 may be welded or otherwise connected to the inwardly facing surfaces of the tower plates 40. The mounting plate 50 may be oriented with the second planar portion 58 oriented approximately horizontal to the ground. The first planar portion 56 may be angled with respect to the ground and the second planar portion 58 to maximize the component of the longitudinal forces applied by the tilt cylinder 38 normal to top surface 52 of the mounting plate 50. Correspondingly, the component of the longitudinal forces applied parallel to the mounting plate 50, and thereby creating torsional loads on the support structure 46, is minimized.

When the implement 24 is engaged from the side, or carries an unbalanced load, horizontal or lateral forces are applied to be vertical support plates 62, 64 by the end of the tilt cylinder 38. These loads are transmitted from the vertical support plates 62, 64 to the gussets 76-80, 86-90 and the mounting plate 50, and from the mounting plate 50 to the lower support plates 100, 106. The loads are further transmitted from the mounting plate 50 and the lower support plate 100, 106 to the tower plates 40. The triangular structure formed by the mounting plate 50 and lower support plates 100, 106, and the merging of the gussets 76-80, 86-90 with the mounting plate 50 provide rigid support horizontally and longitudinally to withstand any loads applied by the tilt cylinder 38 at different angles. The aligned gussets 76-80, 86-90 bridge the center load horizontally to the sides of the mounting plate 50 to provide very effective structural transition of the loads and to provide further resistance to cracking at the intersection of the mounting plate 50 and the vertical support plates 62, 64 due to repetitive loading and fatigue you.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A support structure for a tilt cylinder of a machine, comprising:

a mounting plate having a top surface and an oppositely disposed bottom surface;

a first vertical support plate perpendicular to the mounting plate and having a bottom edge connected to the top surface of the mounting plate, the first vertical support plate having a first circular opening there through proximate a top edge of the first vertical support plate;

a second vertical support plate perpendicular to the mounting plate, parallel to and spaced from the first vertical support plate, and having a bottom edge connected to the top surface of the mounting plate, the second vertical support plate having a second circular opening there through proximate a top edge of the second vertical support plate;

a front central gusset perpendicular to the mounting plate, and perpendicular to and disposed between the first and second vertical support plates, the front central gusset having a bottom edge connected to the top surface of the mounting plate and oppositely disposed lateral edges each connected to a corresponding one of the first and second vertical support plates;

a first front side gusset perpendicular to the mounting plate and to the first vertical support plate, the first front side gusset having a bottom edge connected to the top surface of the mounting plate and a lateral edge connected to a side of the first vertical support plate opposite the second vertical support plate and front central gusset and aligned with the front central gusset;

a second front side gusset perpendicular to the mounting plate and to the second vertical support plate, the second front side gusset having a bottom edge connected to the top surface of the mounting plate and a lateral edge connected to a side of the second vertical support plate opposite the first vertical support plate and front central gusset and aligned with the front central gusset;

a first lower support plate having a bottom edge and a top edge disposed opposite the bottom edge and connected to the bottom surface of the mounting plate; and a second lower support plate having a bottom edge and a top edge disposed opposite the bottom edge and connected to the bottom surface of the mounting plate with the top edge of the first lower support plate being spaced from the top edge of the second lower support plate, and wherein the bottom edge of the first lower support plate is connected to the bottom edge of the second lower support plate so that the first and second lower support plates and a portion of the mounting plate disposed between the top edges of the first and second lower support plates form a triangle in cross-section.

2. The support structure of claim 1, comprising:

a rear central gusset perpendicular to the mounting plate, perpendicular to and disposed between the first and second vertical support plates, and spaced from the front central gusset, the rear central gusset having a bottom edge connected to the top surface of the mounting plate and oppositely disposed lateral edges each connected to a corresponding one of the first and second vertical support plates;

a first rear side gusset perpendicular to the mounting plate and to the first vertical support plate, the first rear side gusset having a bottom edge connected to the top surface of the mounting plate and a lateral edge connected to a side of the first vertical support plate opposite the second vertical support plate and rear central gusset and aligned with the rear central gusset; and a second rear side gusset perpendicular to the mounting plate and to the second vertical support plate, the second rear side gusset having a bottom edge connected to the top surface of the mounting plate and a lateral edge connected to a side of the second vertical support plate opposite the first vertical support plate and rear central gusset and aligned with the rear central gusset.

3. The support structure of claim 2, wherein the rear central gusset has an upper raised portion dimensioned to engage the tilt cylinder before the tilt cylinder rotates into an operator environment of the machine.

4. The support structure of claim 1, wherein the top edge of the first lower support plate is connected to the bottom surface of the mounting plate opposite the bottom edge of the front central gusset.

5. The support structure of claim 1, wherein the mounting plate comprises a first planar portion and a second planar portion oriented at an angle with respect to the first planar portion, and wherein the bottom edges of the first and second vertical support plates are shaped to conform to the shape of the top surface of the mounting plate defined by the first and second planar portions for attachment of the bottom edges to both the first and second planar portions of the mounting plate.

6. The support structure of claim 1, wherein a top edge of the front central gusset has an upper cutout portion dimensioned to receive a portion of the tilt cylinder therein.

7. The support structure of claim 1, wherein the mounting plate, the first and second vertical support plates, and the gussets are formed as a single unitary component by a steel casting process.

8. An end frame for a machine, comprising:

a work material engaging implement;

a tilt cylinder having a first end and a second end, with the first end being operatively connected to the implement, and with the tilt cylinder being operable to adjust an orientation of the implement relative to the end frame; and a tilt cylinder support structure, comprising:

a mounting plate having a top surface and an oppositely disposed bottom surface, a first vertical support plate perpendicular to the mounting plate and having a bottom edge connected to the top surface of the mounting plate, the first vertical support plate having a first circular opening there through proximate a top edge of the first vertical support plate, a second vertical support plate perpendicular to the mounting plate, parallel to and spaced from the first vertical support plate, and having a bottom edge connected to the top surface of the mounting plate, the second vertical support plate having a second circular opening there through proximate a top edge of the second vertical support plate, a front central gusset perpendicular to the mounting plate, and perpendicular to and disposed between the first and second vertical support plates, the front central gusset having a bottom edge connected to the top surface of the mounting plate and oppositely disposed lateral edges each connected to a corresponding one of the first and second vertical support plates, a first front side gusset perpendicular to the mounting plate and to the first vertical support plate, the first front side gusset having a bottom edge connected to the top surface of the mounting plate and a lateral edge connected to a side of the first vertical support plate opposite the second vertical support plate and front central gusset and aligned with the front central gusset, a second front side gusset perpendicular to the mounting plate and to the second vertical support plate, the second front side gusset having a bottom edge connected to the top surface of the mounting plate and a lateral edge connected to a side of the second vertical support plate opposite the first vertical support plate and front central gusset and aligned with the front central gusset, a first lower support plate having a bottom edge and a top edge disposed opposite the bottom edge and connected to the bottom surface of the mounting plate; and a second lower support plate having a bottom edge and a top edge disposed opposite the bottom edge and connected to the bottom surface of the mounting plate with the top edge of the first lower support plate being spaced from the top edge of the second lower support plate, and wherein the bottom edge of the first lower support plate is connected to the bottom edge of the second lower support plate so that the first and second lower support plates and a portion of the mounting plate disposed between the top edges of the first and second lower support plates form a triangle in cross-section, wherein the second end of the tilt cylinder is pivotally connected to the tilt cylinder support structure at the first and second circular openings of the vertical support plates.

9. The end frame of claim 8, wherein the tilt cylinder support structure comprises:

a rear central gusset perpendicular to the mounting plate, perpendicular to and disposed between the first and second vertical support plates, and spaced from the front central gusset, the rear central gusset having a bottom edge connected to the top surface of the mounting plate and oppositely disposed lateral edges each connected to a corresponding one of the first and second vertical support plates;

a first rear side gusset perpendicular to the mounting plate and to the first vertical support plate, the first rear side gusset having a bottom edge connected to the top surface of the mounting plate and a lateral edge connected to a side of the first vertical support plate opposite the second vertical support plate and rear central gusset and aligned with the rear central gusset; and a second rear side gusset perpendicular to the mounting plate and to the second vertical support plate, the second rear side gusset having a bottom edge connected to the top surface of the mounting plate and a lateral edge connected to a side of the second vertical support plate opposite the first vertical support plate and rear central gusset and aligned with the rear central gusset.

10. The end frame of claim 8, wherein the rear central gusset has an upper raised portion dimensioned to engage the tilt cylinder before the tilt cylinder rotates into an operator environment of the machine.

11. The end frame of claim 8, wherein the top edge of the first lower support plate is connected to the bottom surface of the mounting plate opposite the bottom edge of the front central gusset.

12. The end frame of claim 8, wherein the mounting plate comprises a first planar portion and a second planar portion oriented at an angle with respect to the first planar portion, and wherein the bottom edges of the first and second vertical support plates are shaped to conform to the shape of the top surface of the mounting plate defined by the first and second planar portions for attachment of the bottom edges to both the first and second planar portions of the mounting plate.

13. The end frame of claim 8, wherein a top edge of the front central gusset has an upper cutout portion dimensioned to receive a portion of the tilt cylinder therein.

14. A support structure for a tilt cylinder of a machine, comprising:

a mounting plate having a top surface and an oppositely disposed bottom surface;

a first vertical support plate having a bottom edge connected to the top surface of the mounting plate, the first vertical support plate having a first circular opening there through proximate a top edge of the first vertical support plate;

a second vertical support plate spaced from the first vertical support plate and having a bottom edge connected to the top surface of the mounting plate, the second vertical support plate having a second circular opening there through proximate a top edge of the second vertical support plate;

a front central gusset disposed between the first and second vertical support plates and having a bottom edge connected to the top surface of the mounting plate and oppositely disposed lateral edges each connected to a corresponding one of the first and second vertical support plates;

a first front side gusset having a bottom edge connected to the top surface of the mounting plate and a lateral edge connected to a side of the first vertical support plate opposite the second vertical support plate and front central gusset and aligned with the front central gusset;

a second front side gusset having a bottom edge connected to the top surface of the mounting plate and a lateral edge connected to a side of the second vertical support plate opposite the first vertical support plate and front central gusset and aligned with the front central gusset;

a first lower support plate having a bottom edge and a top edge disposed opposite the bottom edge and connected to the bottom surface of the mounting plate; and a second lower support plate having a bottom edge and a top edge disposed opposite the bottom edge and connected to the bottom surface of the mounting plate with the top edge of the first lower support plate being spaced from the top edge of the second lower support plate, and wherein the bottom edge of the first lower support plate is connected to the bottom edge of the second lower support plate so that the first and second lower support plates and a portion of the mounting plate disposed between the top edges of the first and second lower support plates form a triangle in cross-section.

15. The support structure of claim 14, comprising:

a rear central gusset disposed between the first and second vertical support plates and spaced from the front central gusset, the rear central gusset having a bottom edge connected to the top surface of the mounting plate and oppositely disposed lateral edges each connected to a corresponding one of the first and second vertical support plates;

a first rear side gusset having a bottom edge connected to the top surface of the mounting plate and a lateral edge connected to a side of the first vertical support plate opposite the second vertical support plate and rear central gusset and aligned with the rear central gusset; and a second rear side gusset having a bottom edge connected to the top surface of the mounting plate and a lateral edge connected to a side of the second vertical support plate opposite the first vertical support plate and rear central gusset and aligned with the rear central gusset.

16. The support structure of claim 14, wherein the rear central gusset has an upper raised portion dimensioned to engage the tilt cylinder before the tilt cylinder rotates into an operator environment of the machine.

17. The support structure of claim 14, wherein the top edge of the first lower support plate is connected to the bottom surface of the mounting plate opposite the bottom edge of the front central gusset, and the top edge of the second lower support plate is connected to the bottom surface of the mounting plate opposite the bottom edge of the rear central gusset.

18. The support structure of claim 14, wherein the mounting plate comprises a first planar portion and a second planar portion oriented at an angle with respect to the first planar portion, and wherein the bottom edges of the first and second vertical support plates are shaped to conform to the shape of the top surface of the mounting plate defined by the first and second planar portions for attachment of the bottom edges to both the first and second planar portions of the mounting plate.

19. The support structure of claim 14, wherein a top edge of the front central gusset has an upper cutout portion dimensioned to receive a portion of the tilt cylinder therein.

20. The support structure of claim 14, wherein the mounting plate, the first and second vertical support plates, the gussets, and the lower support plates are formed as a single unitary component by a steel casting process.

* * * * *